United States Patent [19]

Charter

[11] 4,214,407

[45] Jul. 29, 1980

[54] WEATHERPROOF JOINT COVER FOR FABRIC ROOFS

[75] Inventor: Kenneth F. Charter, Newark, Ohio

[73] Assignee: Owens-Corning Fiberglas Corporation, Toledo, Ohio

[21] Appl. No.: 952,024

[22] Filed: Oct. 16, 1978

[51] Int. Cl.[2] ..... E04G 11/04; E04C 1/34

[52] U.S. Cl. ..... 52/63; 52/2; 52/83; 52/469

[58] Field of Search ..... 135/150 F; 52/2, 63, 52/83, 465, 469

[56] References Cited

U.S. PATENT DOCUMENTS

| | | | |
|---|---|---|---|
| 3,091,053 | 5/1963 | Giowald | 52/2 |
| 3,564,784 | 2/1971 | Mollinger | 52/63 |
| 3,835,603 | 9/1974 | Schrebci | 52/83 |
| 4,079,480 | 3/1978 | Oase | 52/584 |
| 4,184,294 | 1/1980 | Purvis | 52/2 |

FOREIGN PATENT DOCUMENTS

| | | | |
|---|---|---|---|
| 2144844 | 3/1973 | Fed. Rep. of Germany | 52/2 |
| 2302500 | 7/1973 | Fed. Rep. of Germany | 52/63 |

*Primary Examiner*—William F. Pate, III

*Attorney, Agent, or Firm*—Ronald C. Hudgens; Philip R. Cloutier; Paul J. Rose

[57] ABSTRACT

Fabric restraining cables are anchored at opposite ends to a concrete ring of a roof structure. Each cable has a plurality of bearing plates spaced longitudinally therealong and secured to the upper portion thereof by U-bolts. Clamp mounting base plates also secured at one end by the U-bolts span the spaces between pairs of the bearing plates. Each base plate has a pair of lower clamp plates secured respectively along opposite edge portions thereof. Each lower clamp plate has an upper clamp plate secured thereto and clamping a beaded edge portion of a fabric panel along with upper and lower gaskets therefor. In several embodiments, each upper gasket is extended transversely outwardly from the cable, looped back over the respective row of upper clamp plates, and releasably joined to the opposite extended and looped back upper gasket to provide a joint cover between the opposite fabric panels.

8 Claims, 7 Drawing Figures

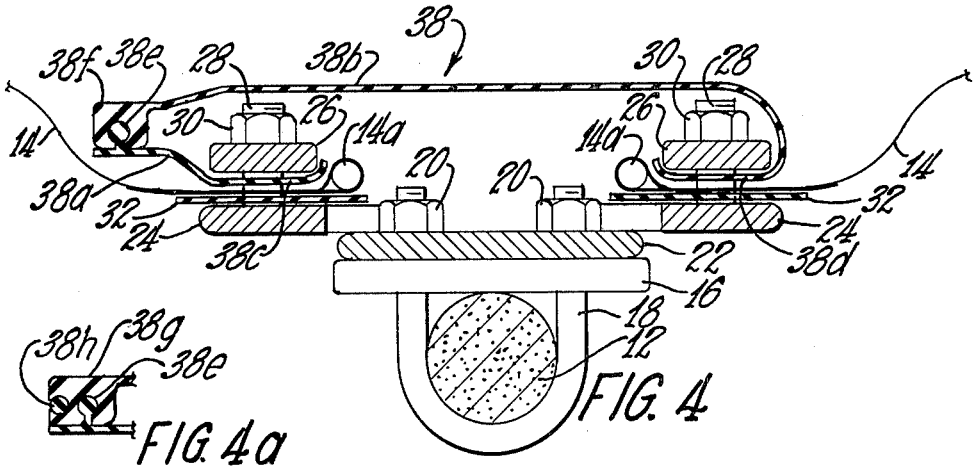
FIG. 4
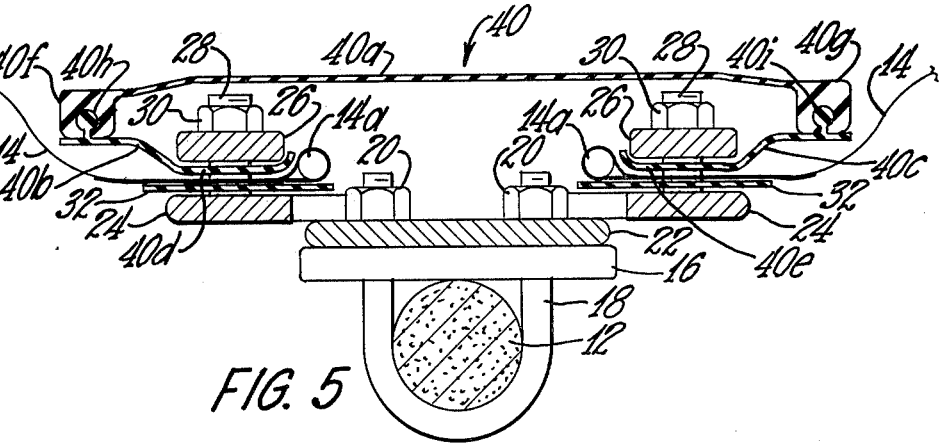
FIG. 4a
FIG. 5
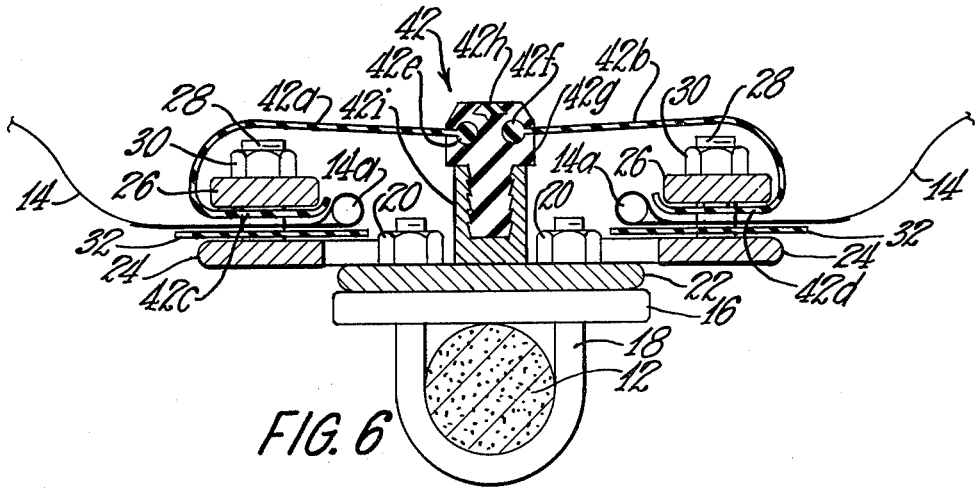
FIG. 6

WEATHERPROOF JOINT COVER FOR FABRIC ROOFS

This invention relates generally to fabric roofs, and more particularly to a weatherproof joint cover means between fabric roof panels clamped on opposite sides of a suspended cable.

An object of the invention is to provide an improved weatherproof joint cover means between fabric roof panels clamped on opposite sides of a suspended cable.

Another object is to provide such a joint cover means which is readily openable and resealable whenever it is desired to inspect the joint hardware.

Other objects and advantages will become apparent when the following specification is considered along with the accompanying drawings in which:

FIGS. 2–6 are partially exploded sectional views taken transversely of a suspended cable of a roof structure and showing various embodiments of the joint cover means of my invention, certain portions being omitted for clarity; and, FIG. 4*a* shows a variation of the structure of FIG. 4.

Figure 1:
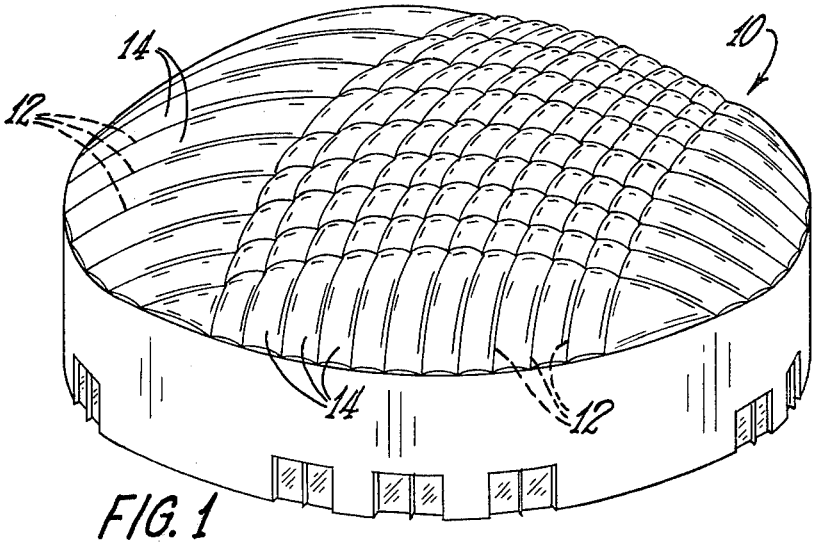
FIG. 1 is a perspective view of a building having an air-supported fabric roof for which the joint cover means of my invention would be useful.

With respect to the drawings, FIG. 1 shows a building 10 having an air-supported fabric roof structure including a plurality of cables 12 and a plurality of fabric panels 14 clamped therebetween. Clamping apparatus which has been found particularly suitable for clamping the panels 14 is disclosed in U.S. Pat. No. 4,079,480, issued Mar. 21, 1978, to Vernon S. Oase, to which reference may be had for better understanding. The embodiments of FIGS. 2–6 include such a clamping apparatus.

In each of FIGS. 2–6, a cable 12 is shown in transverse section. As better shown in the aforesaid patent, each cable 12 has a plurality of bearing pads 16 spaced longitudinally therealong and secured to the upper portion thereof respectively by a plurality of U-bolts 18 provided with nuts 20, only one bearing pad 16 and U-bolt 18 being shown in FIGS. 2–6 of the instant application. An elongated clamp mounting base plate 22 spans the space between each pair of adjacent bearing pads 16, one end merely bearing against a pad 16 and the other end being secured to the other pad 16 by the respective U-bolt 18. Each base plate 22 has a pair of elongated lower clamp plates 24 secured respectively along opposite edge portions thereof on the upper surface thereof by fastening means, preferably bolts, which have been omitted in the interest of clarity. Such fastening means is shown in the above-mentioned patent, however, as threaded studs with nuts. Each lower clamp plate 24 transversely overhangs the respective edge portion of the base plate 22 and has an elongated upper clamp plate 26 secured to the upper surface thereof along the overhanging outer edge portion thereof by a plurality of threaded studs 28 provided with nuts 30, only one stud 28 and nut 30 being shown for each set of clamp plates 24 and 26. Each panel 14 is provided with a beaded edge portion 14*a*. The panels 14 are clamped between the lower clamp plates 24 and upper clamp plates 26 and anchored by the beaded edge portions 14*a*. Lower gaskets 32 are provided between the panels 14 and the lower clamp plates 24.

In each of the embodiments of FIGS. 2–6, combination upper gasket and joint cover means of synthetic rubber material is provided in which the cover portion is readily openable and resealable and still provides a weatherproof joint.

Figure 2:
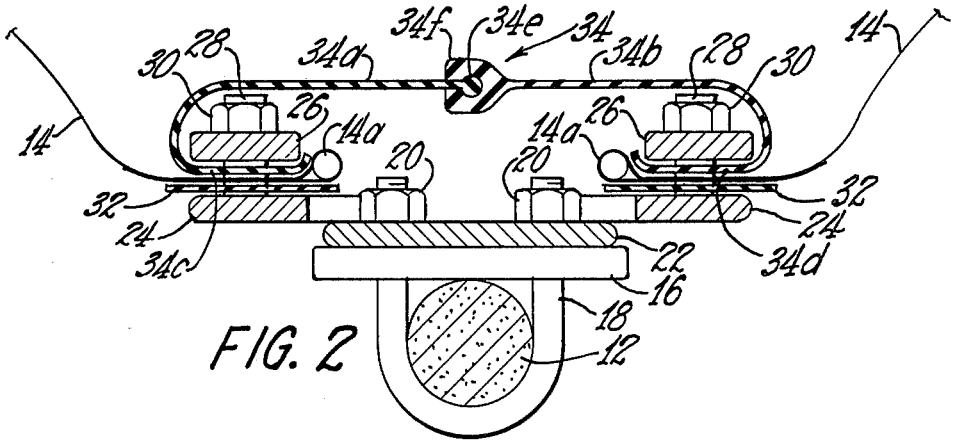

In the embodiment of FIG. 2, a combination upper gasket and joint cover means 34 is provided including a gasket and cover member 34*a* and a gasket and cover member 34*b*. The member 34*a* terminates at one edge in an upper gasket portion 34*c* clamped between the left-hand set of clamp plates 24 and 26 as viewed in FIG. 2, and the member 34*b* terminates at one edge in an upper gasket portion 34*d* clamped between the right-hand set of clamp plates 24 and 26 as viewed in FIG. 2. The members 34*a* and 34*b* loop back over the respective upper clamp plates 26 from the outer edges of the upper gasket portions 34*c* and 34*d*. At their other edges, the member 34*a* terminates in a bead strip 34*e* extending longitudinally of the cable 12 and the member 34*b* teminates in a channel socket 34*f*. The bead strip 34*e* is releasably secured in the channel socket 34*f*, whereby a readily openable and resealable weatherproof joint cover is provided between the fabric panels 14, the cable 12 and all the clamping hardware being fully protected against the weather.

Figure 3:
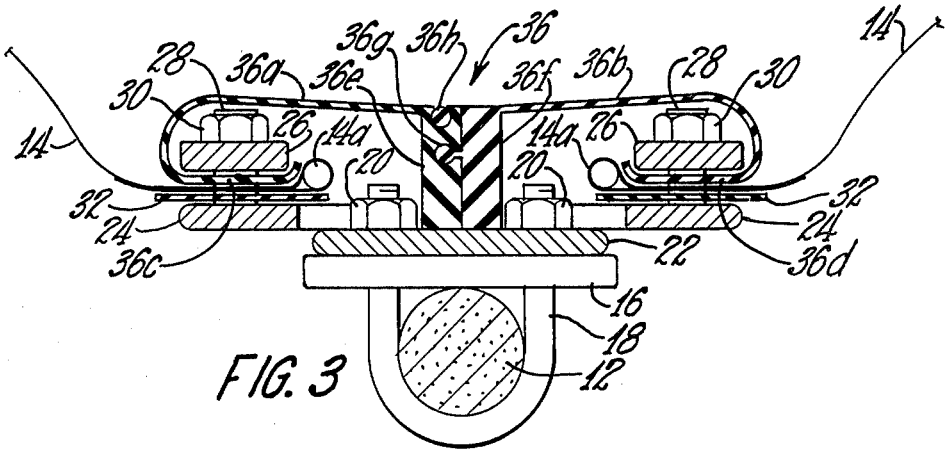

In the embodiment of FIG. 3, a combination upper gasket and joint cover means 36 is provided including a gasket and cover member 36*a* and a gasket and cover member 36*b*. The member 36*a* terminates at one edge in an upper gasket portion 36*c* clamped between the left-hand set of clamp plates 24 and 26 as viewed in FIG. 3, and the member 36*b* terminates at one edge in an upper gasket portion 36*d* clamped between the right-hand set of clamp plates 24 and 26 as viewed in FIG. 3. The members 36*a* and 36*b* loop back over the respective upper clamp plates 26 from the outer edges of the upper gasket portions 36*c* and 36*d*. At their other edges, the member 36*a* terminates in a channel socket portion 36*e* which extends down to and bears against the base plate 22 and the member 36*b* terminates in a beaded portion 36*f* which also extends down to and bears against the base plate 22. The beaded portion 36*f* includes a bead strip 36*g* releasably secured in the channel socket portion 36*e*. Preferably the channel socket portion 36*e* also contains a removable locking strip 36*h* which must be removed before the bead strip 36*g* can be readily removed.

In the embodiment of FIG. 4, a combination upper gasket and joint cover means 38 is provided including a cover anchoring and gasket member 38*a* and a cover and gasket member 38*b*. The member 38*a* terminates at one edge in an upper gasket portion 38*c* clamped between the left-hand set of clamp plates 24 and 26 as viewed in FIG. 4, and the member 38*b* terminates at one edge in an upper gasket portion 38*d* clamped between the right-hand set of clamp plates 24 and 26 as viewed in FIG. 4. The member 38*a* extends outwardly from the outer edge of the upper gasket portion 38*c*, and the member 38*b* loops back over both of the upper clamp plates 26 shown from the outer edge of the upper gasket portion 38*d*. At their other edges, the member 38*a* is provided with a bead strip 38*e* and the member 38*b* terminates in a channel socket 38*f*. The bead strip 38*e* is releasably secured in the channel socket 38*f*. As shown in FIG. 4*a*, an alternative channel socket 38*g* may be provided with a locking strip 38*h* if a more secure fastening is desired between the member 38*a* and the member 38*b*.

In the embodiment of FIG. 5, a combination upper gasket and joint cover means 40 is provided including a cover member 40*a* and a pair of cover anchoring and gasket members 40*b* and 40*c*. The members 40*b* and 40*c* terminate at transversely inner edges respectively in upper gasket portions 40*d* and 40*e* clamped respectively between the sets of clamp plates 24 and 26. At their transversely outer edges, the members 40*b* and 40*c* are provided respectively with bead strip portions 40*h* and 40*i*. The cover member 40*a* extends over both of the upper clamp plates 26 shown and terminates at its transversely outer edges respectively in channel socket portions 40*f* and 40*g* in which the bead strip portions 40*h* and 40*i* are respectively releasably secured.

In the embodiment of FIG. 6, a combination upper gasket and joint cover means 42 is provided including a gasket and cover member 42*a*, a gasket and cover member 42*b*, a metallic anchoring channel 42*i* preferably of extruded aluminum, and a retaining plug strip 42*g*. The member 42*a* terminates at one edge in an upper gasket portion 42*c* clamped between the left-hand set of clamp plates 24 and 26 as viewed in FIG. 6, and the member 42*b* terminates at one edge in an upper gasket portion 42*d* clamped between the right-hand set of clamp plates 24 and 26 as viewed in FIG. 6. The members 42*a* and 42*b* loop back over the respective upper clamp plates 26 from the outer edges of the upper gasket portions 42*c* and 42*d*. At their other edges, the members 42*a* and 42*b* terminate respectively in bead strips 42*e* and 42*f* releasably secured respectively in channel sockets provided in the retaining plug strip 42*g*. Preferably a locking strip 42*h* is provided in the retaining plug strip 42*g* to more securely retain the bead strips 42*e* and 42*g* therein. The anchoring channel 42*i* is suitably secured to the row of base plates 22, as by countersunk screws (not shown). The retaining plug strip 42*g* is secured in the anchoring channel 42*i* by cooperating toothed surfaces provided on these members as shown.

In each of the embodiments of FIGS. 2–6, a weatherproof joint cover between the fabric panels 14 has been provided which completely protects the clamping hardware. Further, the cover is readily openable and resealable.

Various modifications may be made in the structure shown and described without departing from the spirit and scope of the invention. While the invention has been illustrated in FIG. 1 with respect to an air-supported fabric roof, wherein the cables restrain the fabric, it is equally applicable to roofs wherein the fabric is supported by tensioned cables.

I claim:

1. In a fabric roof structure wherein elongated clamp mounting base plates are secured along a suspended cable on the upper side thereof, two elongated lower clamp plates are secured respectively along opposite edge portions of each base plate on the upper surface thereof, two elongated upper clamp plates are secured respectively to the lower clamp plates on each base plate, and edge portions of two fabric panels are clamped between the lower and upper clamp plates respectively on opposite sides of the cable, the improvement comprising a weatherproof joint cover between the fabric panels, the joint cover covering the upper sides of the upper clamp plates on opposite sides of the cable from above, being readily openable and resealable from the upper side of the fabric panels, and including gasket portions between the upper clamp plates and the fabric panels respectively on opposite sides of the cable.

2. A weatherproof joint cover between a pair of spaced fabric panels clamped respectively by two sets of lower and upper clamp plates, the clamp plate sets being disposed above and respectively on opposite sides of a suspended cable and the fabric panels, clamp plates, and cable forming a portion of a fabric roof structure, the joint cover comprising a pair of gasket portions between the upper clamp plates and the fabric panels respectively on opposite sides of the cable and a cover portion covering the upper sides of the upper clamp plates from above and joined to the gasket portions on the outer sides of the upper clamp plates, the joint cover being readily openable and resealable from the upper side of the fabric panels, and the joint cover including the gasket portions and the cover portion being formed in at least two parts having a bead strip and channel socket connection therebetween.

3. A joint cover as claimed in claim 2 and formed as a pair of combination gasket and cover members each terminating at one edge in a gasket portion, one terminating at the other edge in a channel socket portion, and the other terminating at the other edge in a bead strip received in the channel socket portion.

4. A joint cover as claimed in claim 3 wherein a beaded portion having the bead strip thereon and the channel socket portion depend into engagement with base plates on which the clamp plates are mounted.

5. A joint cover as claimed in claim 4 wherein the channel socket portion also contains a separate locking strip for more securely retaining the bead strip therein.

6. A joint cover as claimed in claim 2 and formed as a combination cover anchoring and gasket first member and a combination cover and gasket second member, each member terminating at one edge in a gasket portion, the first member extending outwardly from its gasket portion away from the cable and terminating at its other edge in a portion provided with a bead strip, and the second member looping back over both sets of upper clamp plates from the outer edge of its gasket portion and terminating at its other edge in a channel socket, the bead strip being received in the channel socket.

7. A joint cover as claimed in claim 6 wherein the channel socket also contains a separate locking strip for more securely retaining the bead strip.

8. A joint cover as claimed in claim 2 and formed as a cover member and a pair of combination cover anchoring and gasket members, each cover anchoring and gasket member terminating at an inner edge in a gasket portion and at an outer edge in a portion provided with a bead strip, and the cover member extending over both sets of upper clamp plates and terminating at its opposite edges respectively in a pair of channel sockets, the bead strips being received respectively in the channel sockets.

* * * * *